United States Patent [19]

Achelpohl

[11] Patent Number: 4,826,476

[45] Date of Patent: May 2, 1989

[54] APPARATUS FOR STACKING FLAT ARTICLES, PREFERABLY DOUBLE BAGS MADE OF PLASTIC FILM

[75] Inventor: Fritz Achelpohl, Lengerich, Fed. Rep. of Germany

[73] Assignee: Windmoller & Holscher, Lengerich, Fed. Rep. of Germany

[21] Appl. No.: 30,511

[22] Filed: Mar. 27, 1987

[30] Foreign Application Priority Data

Apr. 2, 1986 [DE] Fed. Rep. of Germany ..... 3611041
Jun. 13, 1986 [DE] Fed. Rep. of Germany ..... 3619933

[51] Int. Cl.[4] ..... B31B 1/98
[52] U.S. Cl. ..... 493/204; 493/196; 83/404
[58] Field of Search ..... 493/196, 204, 341, 343; 83/171, 404

[56] References Cited

U.S. PATENT DOCUMENTS

| | | | |
|---|---|---|---|
| 4,128,049 | 12/1978 | Lehmacher | 493/204 |
| 4,451,249 | 5/1984 | DeBin | 493/204 |
| 4,512,757 | 4/1985 | Dreckmann | 493/194 |
| 4,657,528 | 4/1987 | Achelpohl et al. | 493/204 |

*Primary Examiner*—Frederick R. Schmidt
*Assistant Examiner*—William E. Terrell
*Attorney, Agent, or Firm*—Fleit, Jacobson, Cohn & Price

[57] ABSTRACT

Apparatus for stacking flat articles which in an intermediate portion are formed with locating holes and preferably consist of double bags having opening-defining edges disposed adjacent to their center line. The bags are fed by a wicketer and deposited in a stacking station on an endless stack conveyor and meedled onto raised upstanding stacking pins to form stacks. The stacking pins are operated to be lowered to release the needled stack which then advances to a succeeding severing station provided with a heated knife, which severs the stacks along a center line extending in the direction of stack travel. Additional conveyor belts are provided for retaining the separated stacks on the stack conveyor.

7 Claims, 4 Drawing Sheets

Fig. 5
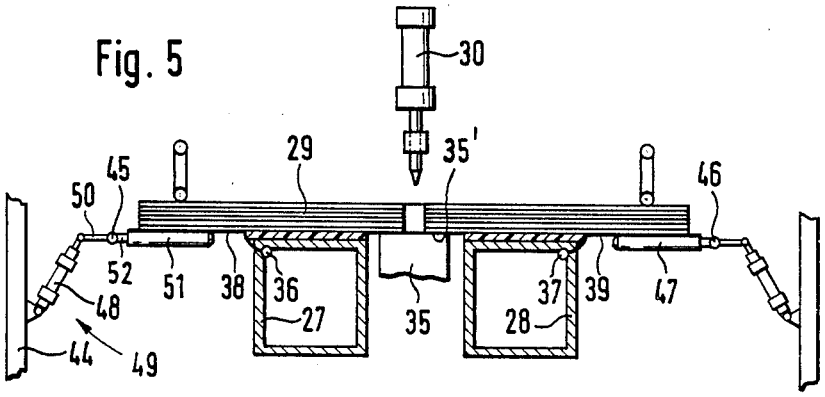
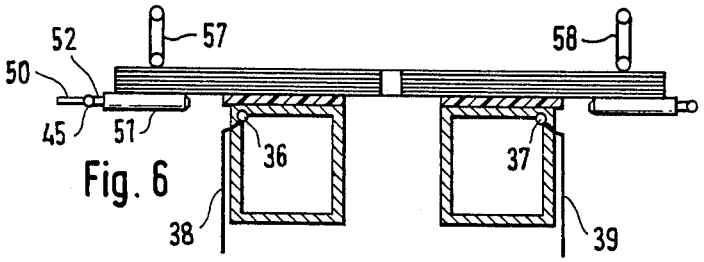
Fig. 6
Fig. 7
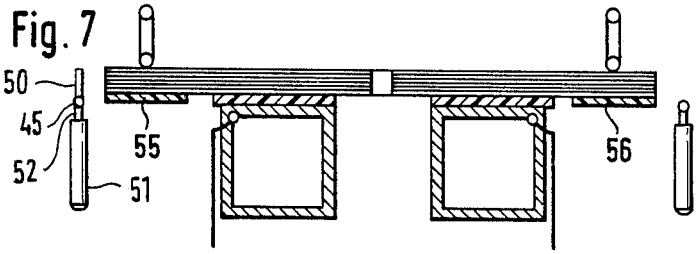
Fig. 9
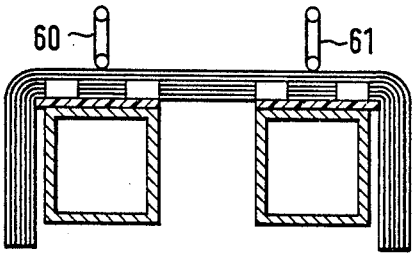

APPARATUS FOR STACKING FLAT ARTICLES, PREFERABLY DOUBLE BAGS MADE OF PLASTIC FILM

FIELD OF THE INVENTION

This invention relates to apparatus for stacking flat articles, which in an intermediate portion are formed with locating holes and preferably consist of double bags. The bags have been severed by hot wire welding from a tubular or semitubular web of plastic film and have opening-defining edges disposed adjacent to their center line. The bags are fed by a transfer device, preferably consisting of a so-called wicketer, which has pairs of transfer arms arranged in a starlike configuration and rotates about a horizontal axis. The bags are deposited in a stacking station on an endless stack conveyor, which comprises tensile means, which are trained around reversing pulleys and are intermittently driven. Apparatus comprising a retaining plate is disposed in the stacking station and carries upstanding stacking pins for needling the articles so as to form stacks. The stacking pins are operated by the intermittent advance operation of the tensile means. A succeeding severing station is also provided including a preferably heated knife, which is movable up and down and severs the stacks along a center line extending in the direction of stack travel. Also, the apparatus comprises means for retaining the separated stacks on the stack conveyor.

BACKGROUND OF THE INVENTION

German Utility Specification No. 81 28 146 discloses an apparatus of the kind mentioned in which the double bags that have been severed from a tubular film along a transverse line by hot wire welding are deposited on stacking plates, which are carried by endless chains and are provided on opposite sides of their longitudinal center line with respective rows of stacking pins for receiving the bags. The means for separating the bag stacks comprise a heated knife, which can be moved up and down and severs the stacks in the severing station between the rows of stacking pins in an operation in which the stacking plate constitutes an abutment for the severing knife. Because the stacking plates constitute also the abutments for the heated knives, the plates must be relatively large and heavy in weight. For this reason the known apparatus constitutes a relatively expensive structure because the endless chains must be provided with stacking plates which must be adapted to constitute abutments for the cutting knife and which have the same spacing as the stacks to be transported by the chains.

SUMMARY OF THE INVENTION

It is an object of the invention to provide an apparatus of the kind described that simplifies and avoids the noted requirements to be met by the stack conveyor, and to provide an apparatus that can be built more easily and more economically.

This object is accomplished in accordance with the invention by providing a stack conveyor that comprises two spaced apart, parallel, revolving belts or chains. Stacking pins are disposed in the stacking station between the courses of the belts or the like of the stack conveyor and in tracks, which are secured to the machine frame, and are adapted to be raised and to be lowered below the plane of travel. A severing knife cooperates in the severing station with an abutment, which is disposed adjacent to the plane of travel between the courses of the endless conveyor.

The stack conveyor of the apparatus in accordance with the invention may consist of simple pairs of conveyor belts or the like, which may be light in weight because the pairs of conveyor belts or the like serve only to convey and retain the stacks and do not carry backing elements which have the same spacing as the stacks and are disposed in the severing station.

In the apparatus in accordance with the invention the supporting means provided in the stacking station consist only of a retaining plate, which carries only two stacking pins or stacking needles. The retaining plate provided with the stacking pins is adapted to be lowered and serves only to assist the formation of each stack in the stacking station.

An abutment for the severing knife is provided in the severing station and s fixed to the frame. As a result, the belts or the like of the stack conveyor need not extend between the severing knife and the abutment as the stacks are severed.

The stacking pins are suitably heated so that they will join the successively stacked double bags in the stack as it is building up. If the conveyor belts or the like which constitute the stack conveyor do not have a sufficiently large width so that overhanging side portions of the bag stacks which have been separated will not adequately be retained on the stack conveyor, roller combs for raising the depending stack portions to the plane of travel may be provided in the severing station on both sides of the conveyor belts or the like and may be pivotally movable about axes which are parallel to the direction of travel.

In accordance with a preferred further feature, the roller combs are pivoted to lateral frame members, which are disposed on opposite sides of the conveyor belts or the like and backing rakes are pivoted to inner frame members and serve to raise the depending lateral stack portions to the plane of travel and have teeth which are staggered from the rollers. In the severing station, the laterally overhanging stack portions are initially raised to the plane of travel so that the laterally disposed roller combs can be swung in between the teeth of the supporting rakes In accordance with a further preferred feature of the invention, laterally disposed backing belts for supporting the stack portions which laterally protrude from the pairs of conveyor belts are provided as a continuation of the roller combs in the plane of travel.

If said laterally disposed backing belts do not ensure a reliable transportation of the separated stacks without a shifting thereof, pressure-applying belts can be provided above the backing belts and may cause the lateral stack portions to be gripped between the lower courses of the pressure-applying belts and the upper courses of the backing belts. The entrance nip defined by the pressure-applying belts may be disposed in the severing station above the roller combs.

In accordance with a further preferred feature of the invention, the retaining means comprise pairs of clamping belts, which serve to clamp the separate stacks between the lower courses of said clamping belts and the upper courses of the conveyor belts. Said pairs of clamping belts will retain the gripped stacks also when they have been centrally severed so that the separated stacks cannot slip although they have depending side portions.

The pressure-applying belts for cooperating with the upper courses of the conveyor belts or the like may closely succeed the stacking station.

The rear reversing pulleys of the pressure-applying belts are suitably mounted in rockers, which are adapted to be raised and lowered, so that the stacks can be taken from the stack conveyor at its delivery end.

The conveyor belts or the like which constitute the stack conveyor are suitably provided with cleats for engaging each stack at its rear and said cleats virtually constitute pushing cleats.

DESCRIPTION OF THE DRAWING

Illustrative embodiments of the invention will now be explained more in detail with reference to the drawing, in which FIG. 1 side elevation showing the stacking apparatus.

FIGS. 3 to 6. are sectional views taken on line C-D in FIG. 1 with the roller combs and backing rakes shown in different positions.

FIG. 7 is a sectional view taken on line E-F in FIG. 1 and showing the stack conveyor FIG. 8 is a side elevation showing a second embodiment of a stack conveyor and FIG. 9 is a sectional view taken on line G-H of FIG. 8 and showing the stack conveyor.

DETAILED DESCRIPTION OF PREFERRED EMBODIMENT

Figure 1:
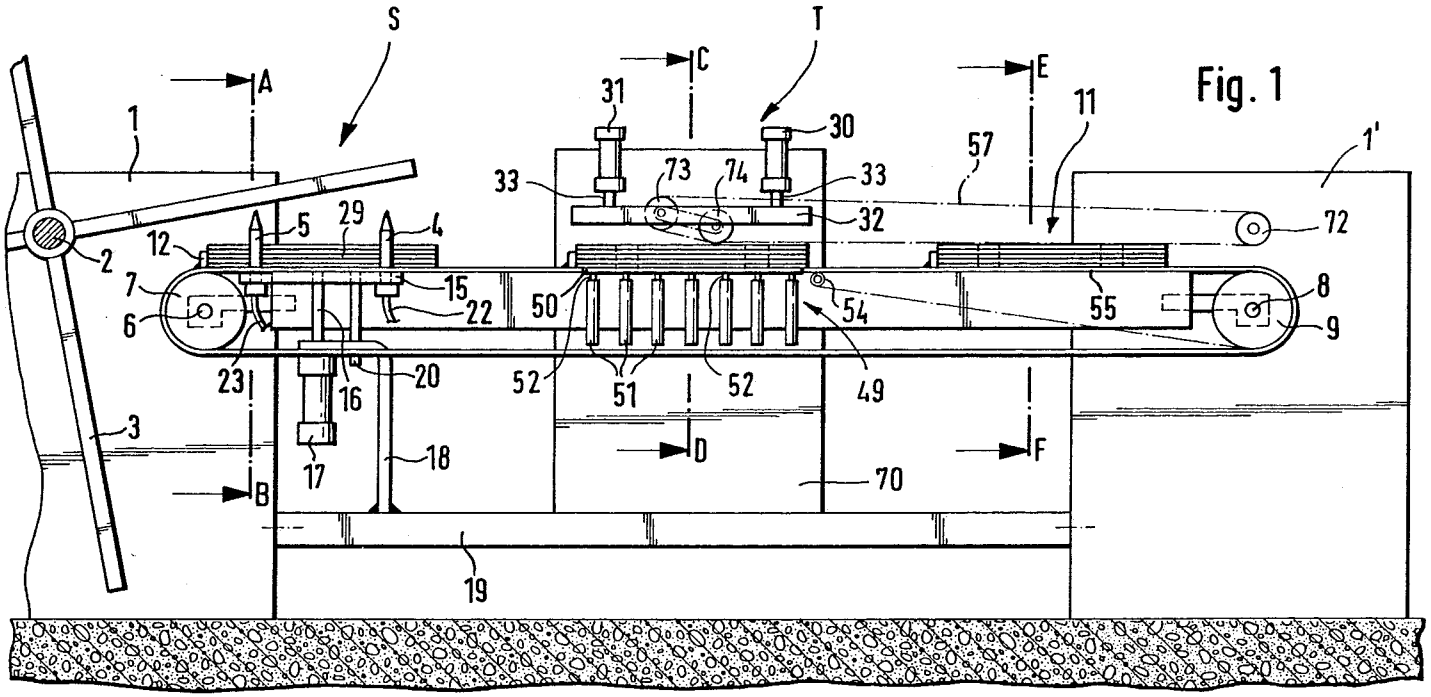

Referring now to the drawing in detail, a shaft 2, which is connected to drive means, not shown, is mounted in side frames 1 of a wicketer frame and carries pairs of transfer arms 3, which are provided with suckers or vacuum gripping means. The wicketer frame is preceded by a hot wire welding machine for severing bags along a transverse line from a tubular or semitubular web of plastic film by hot wire welding. From that hot wire welding machine the rotating transfer arms 3 take over or receive the completed double bags, the individual bags of which are joined along a center line, and needle the double bags on stacking pins or stacking needles 4, 5.

A horizontal shaft 6 is mounted or journalled in the side frames 1 or in laterally disposed bearing brackets forming part of the wicketer frame. The shaft 6 carries two spaced apart reversing pulleys 7, which are symmetrically disposed with respect to the transverse center plane of the pair of transfer arms 3. Another horizontal shaft 8 is mounted or journalled in frame 1' at the delivery end of the stacking apparatus and carries a pair of end reversing pulleys 9 in a corresponding arrangement. Two spaced apart, parallel conveyor belts 10, 10' are trained around the reversing pulleys 7, 9. As FIG. 1 clearly shows, conveyor belts 10 and 10' may be provided with pushing cleats 12. The pulleys 7, 9 of one pair thereof are connected with an intermittently acting drive, which is not shown.

A carrying plate 15 is disposed in the stacking station S between the wicketer arms 3, which are arranged in pairs. The plate 15 carries the stacking pins 4, 5, which are secured to the carrying plate and are spaced apart in the transverse center plane between the wicketer arms 3. The carrying plate 15 is secured at its central portion to piston rod 16 of fluid-operable piston-cylinder unit 17.

The cylinder (fluid connections not shown) of the fluid-operable piston-cylinder unit 17 is connected to the horizontal arm of an angle bracket 18, which is welded to the main carrier beam 19 of the frame of the apparatus. To constrain the carrying plate 15 to move parallel to the piston rod 16, the carrying plate 15 is provided or fixed with a guide pin 20, which extends through a guiding bore in the horizontal arm of the bracket 18.

The stacking pins 4, 5 are heated by an electrical heating cartridge received within the pins, which is fed with heating current by lines 22, 23.

By operating the fluid-operable piston-cylinder unit 17, the carrying plate 15 can be lowered to a position at which the stacking needles 4, 5 are below the upper plane of travel of the conveyor belts 10, 10'.

Figure 2:
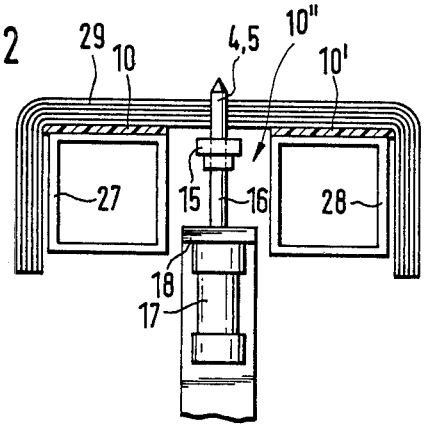
FIG. 2 is a sectional view taken on line A-B in FIG. 1 and showing the apparatus.

It is apparent from FIG. 2 that a gap 10'' defined between the parallel revolving endless conveyor belts 10, 10' and the carrying plate 15, which is provided with the stacking pins 4, 5. Carrying plate 15 is adapted to be raised and lowered in this gap. The conveyor belts 10, 10' are slidingly supported on box-section beams 27, 28 of the frame, which have smooth upper surfaces. As is also apparent from FIG. 2 the side portions of stacks 29 of double bags hang or extend laterally over or beyond the conveyor belts 10, 10'.

In the severing station T, two fluid-operable (fluid connections not shown) piston-cylinder units 30, 31 are secured to a carrier 70, which forms part of the frame. The piston-cylinder units 30, 31 are disposed above the gap 10'' which is defined between the box-section beams 27, 28 and comprise piston rods 33, which in turn carry a heated severing knife 32. The heating of knife 32 can be effected in any way such as by an appropriate electrical heater located along the upper edge of knife 32 or housed within it. The knife 32 is adapted to be moved up and down by the piston-cylinder units 30, 31 in the longitudinal center plane between the beams 27, 28. An abutment 35 having the same longitudinal or axial length as each stack 29 is disposed between the beams 27, 28 and secured to the frame and has a top surface 35' which is aligned with the plane of travel of the bottom of stack 29.

Figure 3:
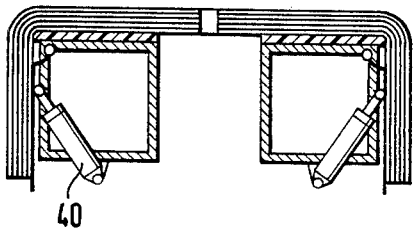

In the upper region or plane of the outside surfaces of the beams 27, 28, backing rakes 38, 39 are mounted in the severing station T for a pivotal movement about parallel axes 36, 37, which are carried by the beams 27, 28 and extend in the direction of travel. The backing rakes 38, 39 comprise a plurality of teeth and are pivotally movable by fluid-operable (fluid connections not shown) piston-cylinder units 40 (FIG. 3) to the plane of travel of the stack to assume the position shown in FIG. 5 and can be swung into retracted position and engagement with the beams 27, 28 to assume the retracted position shown in FIGS. 3, 6 and 7. The cylinders of units 40 are pivotally mounted at the bottom of beams 27, 28 and the pistons are pivotally mounted to the undersurface of rakes 38, 39.

Figure 4:
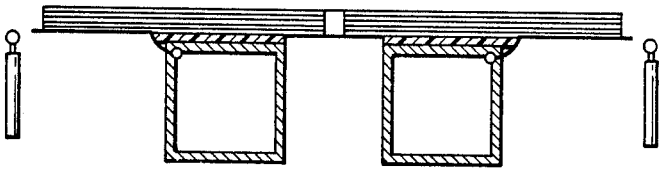

A pair of roller comb assemblies 49 are mounted on outer conveyor belts 10, 10'. The roller comb assemblies 49 are pivotally movable about fixed parallel axes 45, 46, which extend in the direction of travel. These axes 45, 46 can be pivot pins fixed in the frame (not shown). By means of fluid-operable (fluid connections not shown) piston-cylinder units 48, the roller comb assemblies 49 are pivotally movable to the plane of travel to assume the positions shown in FIG. 5 and can be swung to a retracted position as shown in FIGS. 4 and 7. The cylinders of units 48 are pivotally mounted to the outer frame members 44 and the pistons are pivotally connected with the roller comb assemblies 49. Each roller comb assembly comprises a central rod, bar, plate or carrier 50, to which axles 52 rotatably mounting the rollers 51 are secured. The axles 52 extend at right angles to the carrier 50. The rollers 51 are mounted only at one end and the rollers 51 and the teeth of the backing rakes 38, 39 are staggered so that they can interdigitate without contacting each other.

In the direction of travel, the roller comb assemblies 49 and the backing rakes 38, 39 are succeeded by backing belts 55, 56, which are disposed beside the conveyor belts 10, 10' and are trained around reversing end pulleys coaxially mounted with pulleys 9 and end pulleys 54.

Pressure-applying belts 57, 58 are provided above the lateral backing belts 55, 56 and train around reversing pulleys 72, a guide roller 73 and an entrance nip defining roller 74, which is disposed in the severing station T. The pressure-applying belts 57, 58 serve to clamp the stacks which have been conveyed into the severing station.

In the severing station T, the depending side portions of the stacks are raised in the manner which is illustrated in FIGS. 3 to 7. For this purpose the piston-cylinder units 40 are initially actuated to pivotally move the backing rakes 38, 39 to the plane of travel so that the stacks 29 assume a straight configuration on the plane of travel. As soon as the backing rakes have been swung out, the laterally disposed roller comb assemblies 49 are swung in to support the stacks so that the backing rakes 38, 39 can subsequently be swung back to the position shown in FIG. 6. When the double stacks have been severed into individual stacks, the latter are retained between the laterally disposed backing belts 55, 56 and the pressure-applying upper belts 57, 58, as shown in FIG. 7.

The backing rakes 38, 39, on the one hand, and the roller comb assemblies 49, on the other hand, can be swung in and out independently of each other so that a succeeding stack can be moved into the severing station while the last stack which has been centrally severed is removed from th severing station. For this purpose the roller comb assemblies are swung in between the teeth of the backing rakes and the latter are subsequently retracted, that is, swung into engagement with the beams 27, 28 while the stack to be severed s held in position. There is now a gap between the inner ends of the individual rollers of the roller combs and the swung-down backing rakes or the beams and the width of this gap exceeds the height of the stacks which are to be severed so that the movement of the stacks having overhanging side portions into the severing station T will not be obstructed as the gaps between the forward ends of the roller combs and the swung-down backing rakes have a sufficiently large width. When the previously severed stack 29 has been removed the succeeding stack 29 can be moved into the severing station T and the roller comb assemblies 49 are swung out and the backing rakes can subsequently be swung out to raise the depending side portions of the succeeding stack 29 into the plane of travel which is adjoined by the roller comb assemblies 49 when they have been raised. Thereafter the roller comb assemblies are swung in so that the individual stacks which have been separated by the severing cut can be removed.

It is apparent that the roller comb assemblies and backing rakes can be swung in and out in alternation, so that stacks 29 which have been conveyed in close succession into the severing station T can be raised to a straight configuration and can then be severed and removed.

As soon as the carrying arms 3 of the wicketer have needled a stack consisting of a predetermined number of double bags on the stacking pins 4, 5, the feeding of additional bags is interrupted for a short time and the carrying plate 15 provided with the stacking pins 4, 5 is lowered s that the stacks 29 rest freely and with overhanging side portions on the conveyor belts 10, 10'. Because the stacking pins 4, 5 are heated, the bags of each stack will be joined adjacent to the stacking holes. When the stacking pins have been lowered, the conveyor belts 10, 10' are advanced one step by drive means, not shown, so that the stacking station is now empty, the stacking pins can be returned to the needling position and the stacking operation can then be resumed.

In step with the intermittent advance of the conveyor belts 10, 10', the stacks are centrally severed and removed.

A second embodiment of the stacking apparatus will now be explained with reference to FIGS. 8 and 9. In that embodiment, the stacking station S and the severing station T correspond to those which have been described with reference to FIGS. 1 to 7.

Figure 8:
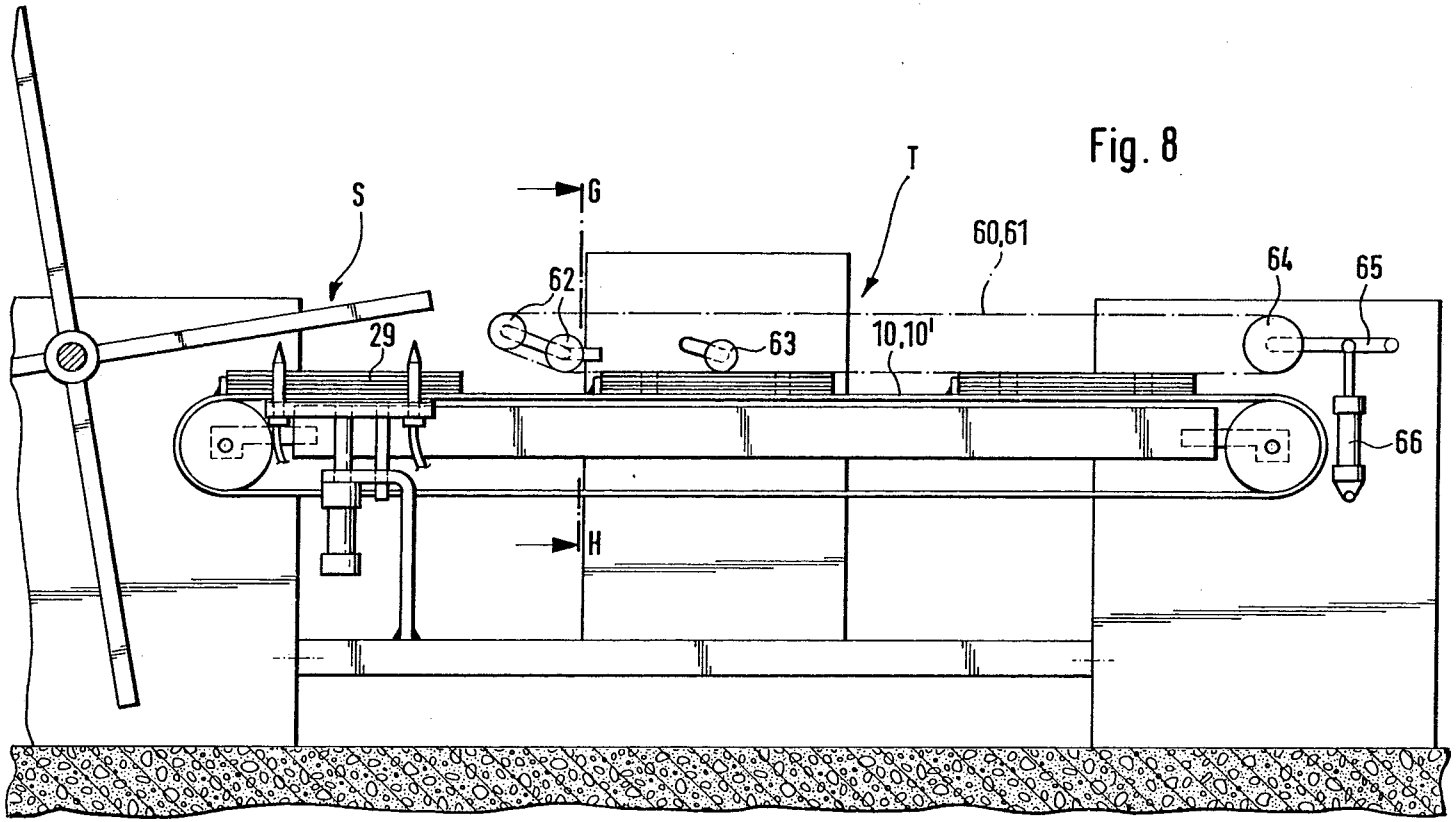

The apparatus shown in FIGS. 8 and 9 differs from the one shown in FIGS. 1 to 7 by the means for retaining the bag stacks 29 on the conveyor belts 10, 10'. Revolving endless clamping belts 60, 61 for retaining the bag stacks 29 are disposed over the conveyor belts 10, 10'. The clamping belts 60, 61 define between pairs of rollers 62, 63 an entrance nip, which closely succeeds the stacking station S and serves to receive the stacks 29, which are thus clamped on the conveyor belts 10, 10' until the stacks are delivered. The clamping lower courses of the gripping belts 60, 61 are biased by spring-loaded pressure-applying rollers 63. The rear reversing pulleys 64 of the clamping belts 60, 61 are mounted in rockers 65, which are adapted to be raised and lowered by fluid-operable piston-cylinder units 66. Rockers 65 are shown in their lowered position in FIG. 8.

The clamping belts 60, 61 are intermittently driven in synchronism with the conveyor belts 10, 10'. In the apparatus shown in FIGS. 8 and 9 there is no need for separate gripping or raising means even in the severing station because the stacks of bags are fixed also in that station.

The illustrative embodiment shown in FIGS. 8 and 9 is much simpler than the one shown in FIGS. 1 to 7 because only a pair of clamping belts 60, 61 for clamping the stacks against the conveying courses of the conveyor belts 10, 10' are provided to hold the stacks in position immediately after the stacks have been formed and as the stacks are severed and intermittently delivered. The rakes and combs are omitted entirely, but the severing mechanism, the same as shown in FIG. 1, is present but not shown.

The locating holes provided in the central region of the flat articles or double bags my be omitted if the stacking pins consist of needles, which are preferably heated too and on which the articles are needled.

For this reason a preferred feature resides in that the stacking pins consist of preferably heated needles, on which articles can be needled which have not been provided with punched holes before.

What is claimed is:

1. Apparatus for stacking flat plastic articles, which consist of double bags, which have been severed by hot wire welding from a tubular or semitubular web of plastic film and which have opening-defining edges disposed adjacent to their center line comprising:

stacking means for receiving the double bags in a stacked condition including a retaining plate having mounted thereon upstanding pins for needling said double bags to form stacks of said double bags, transfer means for depositing the double bags on said stacking means in a stacked condition, severing means including a knife movable up and down and a cooperating abutment to sever the stacks along a center line of the double bags forming each stack to produce two separated stacks, pivotally mounted roller comb means adjacent said severing means, the pivotally mounted roller comb means including a plurality of rollers for holding lateral stack portions.

pivotally mounted backing rake means including a plurality of rake teeth for raising said lateral stack portions, said teeth and rollers being staggered for interdigitation.

conveying means comprising two spaced apart, parallel, revolving elongated members cooperating with said stacking means to move the stacks from said stacking means to said severing means and the separated stacks away from said severing means, retaining means for retaining the separated stacks on said conveying means, the upstanding pins of said stacking means being disposed between courses of the elongated members of the conveying means, and raising and lowering means for raising the upstanding pins to an operative position where the double bags can be needled onto said pins and for lowering the upstanding pins to an inoperative position where the pins are withdrawn from the double bags which then can be moved from said stacking means to said severing means.

2. Apparatus according to claim 1 wherein the upstanding pins are heated.

3. Apparatus according to claim 1 wherein said rollers terminate spaced from the conveying means by a gap which has a width that exceeds the height of a stack to allow a stack to be moved to the severing means while said rollers are holding lateral stack portions of a preceding stack.

4. Apparatus according to claim 1 wherein elongated backing means are provided for supporting lateral stack portions as said conveying means moves stacks from the severing means.

5. Apparatus according to claim 4 wherein elongated pressure-applying means are provided to coact with said elongated backing means for gripping the lateral stack portions.

6. Apparatus according to claim 5 wherein entrance nips are defined by the elongated pressure-applying means in the severing means relative to the roller comb means.

7. Apparatus according to claim 1 wherein the conveying means includes conveyor belts provided with cleats.

* * * * *

UNITED STATES PATENT AND TRADEMARK OFFICE

CERTIFICATE OF CORRECTION

PATENT NO. : 4,826,476

DATED : May 2, 1989

INVENTOR(S) : ACHELPOHL

It is certified that error appears in the above-identified patent and that said Letters Patent is hereby corrected as shown below:

In the Abstract, line 6, change "meedled" to --needled--.

Signed and Sealed this

Second Day of April, 1991

*Attest:*

HARRY F. MANBECK, JR.

*Attesting Officer*

*Commissioner of Patents and Trademarks*